US006726778B2

(12) United States Patent
Wang et al.

(10) Patent No.: US 6,726,778 B2
(45) Date of Patent: Apr. 27, 2004

(54) METHOD FOR CLEANING AND RENOVATING PIPELINES

(75) Inventors: Xiao Ming Wang, Montreal (CA); Xiao Jun Wang, Shanghai (CN)

(73) Assignee: JE Cleanpress Ltd. Co. (CA)

( * ) Notice: Subject to any disclaimer, the term of this patent is extended or adjusted under 35 U.S.C. 154(b) by 0 days.

(21) Appl. No.: 10/317,254

(22) Filed: Dec. 10, 2002

(65) Prior Publication Data

US 2003/0134037 A1 Jul. 17, 2003

Related U.S. Application Data

(63) Continuation-in-part of application No. 10/044,243, filed on Jan. 14, 2002, now abandoned.

(51) Int. Cl.[7] ..... B08B 3/02; B08B 9/02; B08B 9/027

(52) U.S. Cl. ..... 134/8; 134/6; 134/7; 134/166 R; 134/169 C

(58) Field of Search ..... 134/6, 7, 166 R, 134/169 C, 8, 166 A

(56) References Cited

U.S. PATENT DOCUMENTS

| | | | | | |
|---|---|---|---|---|---|
| 1,890,164 | A | | 12/1932 | Rosengerger | |
| 2,087,694 | A | | 7/1937 | Malmros | |
| 2,089,597 | A | * | 8/1937 | Carter | 451/76 |
| 3,073,687 | A | | 1/1963 | McCune | |
| 3,082,073 | A | | 3/1963 | McAnneny | |
| 4,583,585 | A | * | 4/1986 | Estienne et al. | 165/94 |
| 4,684,296 | A | * | 8/1987 | Horii et al. | 406/153 |
| 4,776,794 | A | * | 10/1988 | Meller | 433/216 |
| 4,816,296 | A | * | 3/1989 | Gibson | 427/183 |
| 5,007,461 | A | * | 4/1991 | Naf | 138/97 |
| 5,013,368 | A | * | 5/1991 | Maroy et al. | 134/22.11 |
| 5,045,352 | A | * | 9/1991 | Mueller | 427/235 |
| 5,499,659 | A | * | 3/1996 | Naf | 138/97 |
| 5,674,323 | A | * | 10/1997 | Garcia | 134/1 |
| 5,783,256 | A | * | 7/1998 | Matsuda et al. | 427/238 |
| 5,924,913 | A | | 7/1999 | Reimelt | |
| 6,027,572 | A | * | 2/2000 | Labib et al. | 134/8 |
| 6,155,751 | A | | 12/2000 | Lane et al. | |

FOREIGN PATENT DOCUMENTS

| | | | |
|---|---|---|---|
| CA | 2311049 A1 | * | 10/2001 |
| EP | 000027980 | * | 5/1981 |
| GB | 2140337 | | 11/1984 |
| RU | 449800 | * | 5/1975 |

* cited by examiner

*Primary Examiner*—Zeinab El Arini
(74) *Attorney, Agent, or Firm*—Bachman & LaPointe

(57) ABSTRACT

A pipeline cleaning and renovating method of the present invention comprises introduction of abrasive particulates by pressurized air through the pipelines to remove the incrustation adhering to the inner surface of the pipelines. Water or other liquids are introduced into the pipelines to generate or increase a moisture content in a flow of the pressurized air. The air flow through the pipelines is controlled to induce a substantially helical flow pattern such that a substantial amount of abrasive particulates are driven by the air flow to move along the inner surface of the pipeline in order to efficiently remove the incrustation. After the pipelines are cleaned, a coating material is added into the pipelines and driven by the air flow in the substantially helical flow pattern to provide an even coating film on the cleaned inner surface of the pipelines. This method can be broadly applied to various types of pipelines and various diameters of the pipelines from 13 mm to 300 mm. The length of the pipeline being cleaned at one time can be from several hundred meters to more than one kilometer, depending on the type of pipeline.

17 Claims, 2 Drawing Sheets

Middle pressure, middle speed: ring - shape

Low pressure, low speed: wave - shape (picture 1)

Middle pressure, middle speed: ring - shape

High pressure, high speed: smog - shape

METHOD FOR CLEANING AND RENOVATING PIPELINES

CROSS-REFERENCE TO RELATED APPLICATIONS

This is a Continuation-In -Part of U.S. patent application Ser. No. 10/044,243 filed Jan. 14, 2002, which the Applicant expressly abandoned on Jun. 11, 2003.

TECHNICAL FIELD

The present invention relates to a method for cleaning and renovating pipelines, in particular for cleaning and renovating pipelines which are difficult to access, such as pipelines buried underground, installed in walls, and the like

BACKGROUND OF THE INVENTION

As is well known, after pipelines have been in use for some time incrustation accumulates therein, which arises partly from salts in the fluids passing therethrough and partly from corrosion of the pipelines. The incrustation usually further includes thick and tough deposits of micro-organisms such as algae, bacteria, etc., which steadily increase over time. The pipelines can be cleaned by chemical cleaning, knocking and mechanical cleaning. These cleaning methods have their disadvantages and negative affects on the pipelines, or have limited applicabilities. A popularly used method is to clean the inner surface of the pipelines by supplying a fluid stream containing abrasive agents such as sand, through the pipelines so that the abrasive agents impinge upon the inner surfaces of the pipelines to remove the deposits thereon.

Examples of applying this method for pipeline cleaning are described in U.S. Pat. No. 1,890,164, entitled SAND BLASTING METHOD AND APPARATUS and issued to Rosenberger on Dec. 6, 1932, U.S. Pat. No. 2,087,694, entitled CLEANING PIPE and issued to Malmros on Jul. 20, 1937, U.S. Pat. No. 3,073,687, entitled METHOD FOR THE CLEANING OF PIPELINES and issued to McCune on Jan. 15, 1963 and U.S. Pat. No. 5,924,913, entitled PROCESS FOR RENOVATING PIPES and issued to Reimelt on Jul. 20, 1999.

More especially, in United Kingdom patent application 2,140,337, which is entitled CLEANING AND LINING A PIPE and published on Nov. 28, 1984, Shinno describes a method for renovating a pipe which comprises cleaning an internal surface of the pipe by supplying a fluid stream containing at least entrained abrasive agents and thereafter lining the pipe by introducing into the pipe a mixed stream of paint and air to deposit paint on the cleaned internal surface of the pipe. The mixture stream used in Shinno's cleaning and lining process is subjected to pulsations in a predetermined cycle and at a predetermined pulsation rate. Shinno states that in a conventional system, when a flow speed of the mixture stream reaches 30–100 m/sec, the air current is turbulent, and the flow speed near the inner surface of the pipe is slower than the flow speed at the center portion of the pipe. Shinno therefore suggests using a rotating vane as a pulsation-generating apparatus installed within the pipeline to be cleaned in order to reduce the fluid speed difference between the flow through the center of the pipe and the flow near the inner surface of the pipe. The suggested flow speed is 20–100 m/sec. Shinno's system is relatively complicated and it is not convenient to install the pulsation-generating apparatus in pipelines. The pulsation-generating apparatus installed in the pipelines can cause fluid flow resistance which is not desirable. The length of the pipelines which can be cleaned according to Shinno is about 30–100 meters, therefore more than 10 vertical holes would have to be dug in streets when, for example a one kilometer length of pipeline buried underground is to be cleaned. This is not satisfactory. Therefore a simple and efficient method for cleaning and renovating pipelines is desirable.

SUMMARY OF THE INVENTION

One object of the present invention is to provide a pipeline cleaning and renovating method in order to clean and renovate pipelines effectively.

In accordance with one aspect of the present invention, a method of cleaning a pipeline having open entry and exit ends, comprises steps of introducing a plurality of abrasive particulates into the pipeline from the entry end thereof by means of pressurized fluid; and controlling a flow of the pressurized fluid at the entry end of the pipeline to induce a substantially helical flow pattern along an inner surface of the pipeline, thereby causing a substantial amount of the abrasive particulates to move along the inner surface of the pipeline.

In accordance with another aspect of the present invention, a method of cleaning a pipeline having open entry and exit ends, comprises steps of introducing a plurality of abrasive particulates into the pipeline from the entry end thereof by means of pressurized air; introducing a liquid into the pipeline from the entry end thereof and thereby generating or increasing a moisture content of the liquid in a flow of the pressurized air; and controlling the flow of the pressurized air at the entry end of the pipeline to induce a substantially helical flow pattern along an inner surface of the pipeline, thereby causing a substantial amount of the abrasive particulates to move along the inner surface of the pipeline.

The method preferably comprises a further step after the pipeline is cleaned, of introducing a coating material into the pipeline by, for example an air flow in a substantially helical flow pattern along the inner surface of the pipeline, thereby moving a substantial amount of the coating material in the substantially helical flow pattern on and along the inner surface of the pipeline.

The substantially helical flow pattern is preferably obtained by controlling the speed of the air flow. In accordance with Applicant's test results, the flow speed through a pipeline reaches about 40 m/sec–100 m/sec the air flow is rotated to create a substantially helical flow pattern, although other flow patterns may jointly exist. The substantially helical flow pattern in the pipeline causes a substantial amount of the abrasive particulates or the coating material to move along the inner surface of the pipeline such that the inner surface of the pipeline is effectively cleaned or coated.

The pipeline cleaning and renovating method of the present invention advantageously provides very effective cleaning results for a relatively long length of pipelines at one time and uniform coating to the inner surface of the cleaned pipelines in order to protect the surface from incrustation for a relatively long period of time. The pipeline cleaning and renovating process is relatively easy to conduct which results in less labour and time consumption and thereby, lowers costs.

Other advantages and features of the present invention will be better understood with reference to the preferred embodiment of the present invention described hereinafter.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENT

Figure 1:
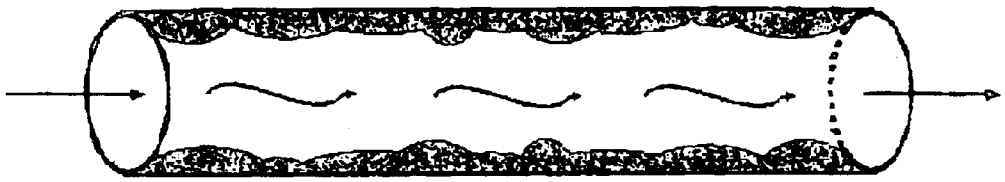
FIGS. 1–3 are schematic illustrations showing air flow patterns within a section of a pipeline when the speed of the air flow is controlled within various predetermined speed ranges.

The pipeline cleaning and renovating method will now be described in detail, as embodiments of the present invention. The pipelines to be cleaned can be, for example water pipes buried underground, installed in the walls of a high-rise building, or in other locations. Therefore, preliminary planning is needed prior to pipeline cleaning and renovating on site. During the preliminary planning stage, the layout of the pipelines, including switches, branches, etc. should be defined according to the construction drawings. The sections of the pipelines to be cleaned at one time are to be divided to have open ends according to the layout of the pipelines. For a straight pipeline buried underground, the length of the pipeline to be cleaned at one time can be several hundred meters to more than one kilometer depending on the diameter of the pipeline, which can vary from 13 mm to 300 mm. The entry end and exit end as well as the flow direction through the pipeline section are also determined together with the determination of pipeline sections. The type of pressurized fluid used for cleaning and renovating pipelines can vary. Nevertheless, the most convenient and inexpensive pressurized fluid is pressurized air. A final step of the preliminary planning stage is to select pressure air volume, air flow speed and the air pressure to be used in the pipeline cleaning and renovating process. The air flow speed is selected from a range of between 40 m/sec and 100 m/sec, preferably 70 m/sec–80 m/sec and the air pressure is selected from a pressure range of between 2–8 kg/cm$^2$ depending on the length and diameter of the selected section of the pipeline and on other considerations, to ensure that the air flow reaches the selected flow speed. For example, the air pressure should be increased 0.5 kg per 10 meters of rise when the pipeline is substantially in a vertical condition, such as in a high-rise building. The determined volume of the pressurized air depends on the diameter of the selected section of the pipeline to be cleaned.

The type of abrasive particulates is also selected during this planning step, for example the abrasive particulates from sands including quartz, iron or steel particulates. When a coating of the inner surface of the section of the pipeline after cleaning is required, the type of coating material is also selected. The coating material must be harmless to health, water resistant, preferably wear resistant and quick-drying material such as rosin.

The next stage is site preparation. The water supply to the pipelines is shut down and a first section of the pipeline to be cleaned according to the preliminary planning, is located and cut from the pipeline. The terminal equipment, if any, is removed such that the section of the pipeline has two open ends and is ready to be cleaned. The pipeline section is connected at its predetermined entry end to an apparatus for controllably supplying the pressurized air and the abrasive particulates to generate an air flow mixed with the abrasive particulates in the desired substantially helical flow pattern, through the section of the pipeline. The apparatus will be described below with reference to FIG. 4. A flexible pipe is preferably connected to the exit end of the section of the pipeline in order to direct the exhaust flow of the mixture for the waste collection. A safety check is conducted for a safe operation of the cleaning and renovating process. For example, all valves installed in the section of the pipeline to be cleaned must be open, or removed if the valve cannot be fully opened, such as butterfly valves.

The cleaning and renovating process begins with introducing the pressurized air supply into the entry end of the section of the pipeline to be cleaned. This is a preliminary air cleaning step without the abrasive particulates to be used later in this step. The section of the pipeline to be cleaned usually contains some water remaining therein. The pressurized air flow will blow the remaining water out of the section of the pipeline. Furthermore, the inner surface of the section of the pipeline to be cleaned may be heavily encrusted at some points and will clog easily when a certain amount of abrasive particulates or the removed deposits pass through those heavily encrusted points. Therefore, the air flow under pressure without the mixed abrasive particulates first removes those deposits which are relatively easy to dislodge, and increases the passage cross-section, particularly at those heavily encrusted points. Thus, the risk of clogging the section of the pipeline to be cleaned when the abrasive particulates are introduced is significantly reduced.

During the preliminary air cleaning step, a mixed stream of air and water under pressure can replace the air flow to be introduced into and through the section of the pipeline being cleaned, which will be referred to below as a wet operation. The mixed stream of air and water is heavier than the air flow and thereby carries a greater amount of inertia, which makes the fluid flow more powerful for dislodging the deposits. Furthermore, the water contained in the mixed stream provides lubrication when the dislodged deposits are blown through the inner passage of the section of the pipeline while being discharged, and thereby further reduces the risk of clogging the section of the pipeline.

Figure 2:
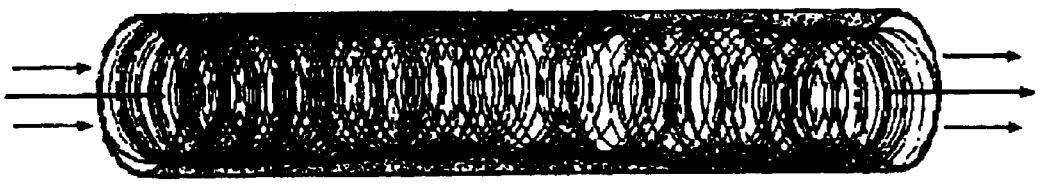
Figure 3:
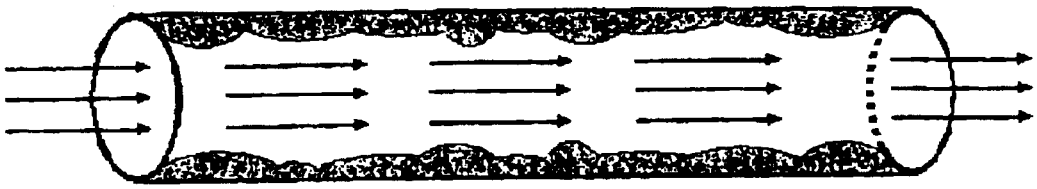

After the preliminary air cleaning step, the air flow introduced into the section of the pipeline being cleaned is adjusted to reach the selected flow speed, between 40–100 m/sec, preferably 70–80 m/sec, and the abrasive particulates are controllably introduced into the entry end of the section of the pipeline being cleaned, in order to ensure that the air flow with the mixed abrasive particulates is generated in the desired substantially helical flow pattern. Tests show that different flow patterns through a pipe can be achieved when the flow speed is varied, as illustrated in FIGS. 1–3. The flow pattern under a relatively low air pressure and at a low air flow speed produces a moderate turbulence in a wave-shaped pattern, as illustrated in FIG. 1. When the air pressure is increased and the air flow speed reaches the range of between 40–100 m/sec, the air flow through the pipe produces a substantially helical flow pattern as illustrated in FIG. 2, although other flow patterns may jointly exist. When the air pressure is further increased and the air flow speed exceeds 100 m/sec, the substantially helical flow pattern through the pipe no longer occurs and a smog-shaped straight flow pattern is produced, as illustrated in FIG. 3. These flow patterns can be observed when the exhaust flow is discharged from the exit end of the pipe, particularly if the flow is mixed with a coloured coating material such as rosin. The cleaning and renovating method of the present invention uses the substantially helical flow pattern to cause a substantial amount of the abrasive particulates to move along the inner surface of the pipeline section, thereby impinging upon the deposits adhering to the inner surface and removing the same therefrom. The removed deposits are then blown out of the exit end of the pipeline section by the air flow.

It is optional to heat the section of the pipeline being cleaned prior to the abrasive particulates cleaning step in order to dry the incrustation on the inner surface of the section of the pipeline being cleaned. The heating step is conducted by introducing hot airflow through the section of the pipeline. The temperature of the hot air can be selected from a temperature range of between 30° C. and 40° C. Neverthless, in a wet operation, there is no need for drying the section of the pipeline being cleaned. After the abrasive particulates cleaning step is completed, a quality check is conducted to ensure the fineness and cleanness of the inner surface of the section of the pipeline which has been cleaned.

It is preferable to introduce a liquid, for example water in most applications, which are referred to as wet operations, into the section of the pipeline from the entry end thereof, thereby generating or increasing moisture content in the flow of the pressurized air. Similar to the water included in the mixed stream of air and water used in the preliminary cleaning step, the moisture in the air flow increases the density of the air flow and thus, the air flow in the substantially helical flow pattern more powerfully drives the abrasive particulates to impinge upon the incrustation adhering to the inner surface of the section of the pipeline. The moisture also provides lubrication to the abrasive particulates and the dislodged deposits when they are blown through the section of the pipeline. This wet operation further eliminates the need for heating the section of the pipeline. As an overall result, the cleaning process reaches a high level of efficiency.

Nevertheless, the introduction of water in this cleaning step must be conducted with a limited quantity and a controlled rate such that the water added into the air flow will be blown into fine particles suspended therein, to generate or increase the moisture content of the air flow. Excess water will form drops and bond the abrasive particulates to form large pellets, which create a high risk of clogging the section of the pipeline being cleaned, and must be avoided.

A coating step is similar to the abrasive particulate cleaning step. The coating material, for example rosin, is introduced into the entry end of the section of the pipeline which has been cleaned by an air flow under the predetermined pressure flowing through the section of the pipeline. The air flow under the predetermined pressure is controlled to reach a predetermined flow speed of between 40–100 m/sec, preferably 70–80 m/sec in order to induce a substantially helical flow pattern through the section of the pipeline. Thus, the semi-liquid rosin is blown into the section of the pipeline and a substantial amount of rosin is brought by the substantially helical flow pattern to move on and along the inner surface of the section of the pipeline, thereby forming a rosin film of 0.2–0.3 mm thick, covering the entire inner surface of the section of the pipeline. The rosin coating can be allowed to dry naturally or can be dried by introducing a hot air flow through the section of the pipeline. After the rosin coating is completely dried, the apparatus which is used to introduce the pressurized air flow and the abrasive particulates as well as the coating material, is then disconnected from the entry end of the section of the pipeline. The flexible tube connected to the exit end of the section of the pipeline is also disconnected. This cleaned and renovated section of the pipeline is then ready to be re-coupled to the pipelines when adjacent sections of the pipelines have been cleaned and renovated.

The substantially helical flow pattern is imprinted on the inner coating of the cleaned and renovated section of the pipeline, which can be observed from one end of a section of the pipeline if this section is straight.

When the section of the pipeline to be cleaned has small cracks or tiny holes, those defects can be automatically repaired during cleaning and renovating procedures. The abrasive particulates driven by the air flow in the substantially helical flow pattern through the section will move into the fine cracks and tiny holes in the pipe wall and will lodge there. The rosin coating will adhere those abrasive particulates to the pipe wall and further cover the same. The rosin coating becomes very solid after drying and will also protect the mended defects.

In a further embodiment of the present invention, other types of liquid can be selected to replace water, to be introduced into the section of pipeline, especially when the incrustation adhering to the inner surface of the section of pipeline to be cleaned is solid or semi-solid and very sticky to clean, such as asphalt-type incrustations accumulated in an oil pipeline. The liquid is selected such that the liquid can at least partially dissolve the solid or semi-solid material included in the deposits accumulated in the section of the pipeline to be cleaned. This selection can be determined according the results of tests conducted prior to the preliminary planning of the cleaning and renovating process. Once the liquid selection is determined from the test results, this liquid can be used in both the preliminary air cleaning step and the abrasive particulates step, which are similar to the wet operation with water and will not therefore be redundantly described.

Figure 4:
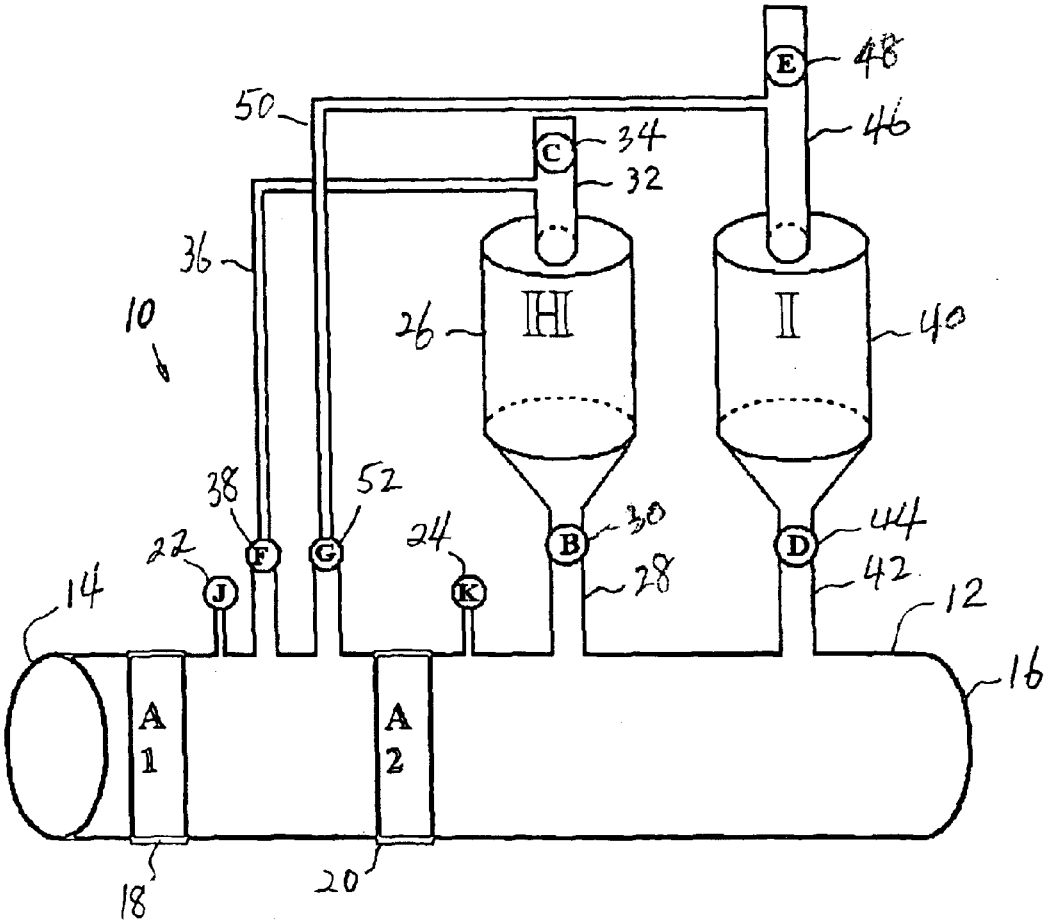
FIG. 4 is a schematic illustration showing an apparatus used in a preferred embodiment of the present invention.

As illustrated in FIG. 4, the apparatus used in the above described embodiment of the present invention, generally indicated by numeral 10 includes a section of a connection pipe 12 having a first end 14 for connection to a pressurized air source, such as an air compressor or pressurized air container (not shown), and a second end 16 for connection to an entry end of the section of a pipeline to be cleaned (not shown). The diameter of the connection pipe 12 is preferably equal to the diameter of the section of pipeline to be cleaned. The connection pipe 12 is provided with a first main control valve 18 positioned near the first end 14 of the connection pipe 12, and a second main control valve 20 downstream of the first main control valve 18. Air pressure indicators 22 and 24 are installed in the connection pipe 12 for measuring the air pressure inside of the connection pipe 12. The air pressure indicator 22 is positioned between the main control valves 18 and 20, and the air pressure indicator 24 is positioned downstream of the second main control valve 20.

The apparatus 10 further includes a first container 26 containing for example, sand, which will be referred to below as the sand container. The sand container 26 is preferably positioned above the connection pipe 12 and is removeably attached to the connection pipe 12 via an output pipe 28 with a control valve 30 for controllably delivering the sand from the sand container 26 into the connection pipe 12. The output pipe 28 is connected to the connection pipe 12 downstream of the second main control valve 20. The sand container 26 has an input pipe 32 with a control valve 34. A back pressure pipe 36 with a valve 38 is provided to interconnect the connection pipe 12 and the sand container 26. The back pressure pipe 36 at its one end is detachably connected to the input pipe 32 and at its other end is connected to the connection pipe 12 at a position between the two main control valves 18 and 20.

Optionally, a second container 40 is provided, preferably positioned above the connection pipe 12. The second container 40 is removeably attached to the connection pipe 12 via an output pipe 42 with a control valve 44. The output pipe 42 is connected to the connection pipe 12 close to the second end 16 thereof. The second container 40 further includes an input pipe 46 with a valve 48. A back pressure pipe 50 with valve 52 is provided to interconnect at one end thereof the input pipe 46 and at the other end thereof to the connection pipe 12 at a position between the main control valves 18 and 20. The connection of the back pressure pipe 50 to the input pipe 46 is detachable.

In operation, the apparatus 10 is connected at its second end 16, perhaps via an extension pipe, to the entry end of the section of the pipeline to be cleaned and at its first end 14 to the air compressor. The air compressor is enabled to provide 2 $m^3$/min to 30 $m^3$/min under a pressure range of from 2–8 kg/$cm^2$, depending on the preliminary planning of the cleaning and renovating process. If the pressurized air supply is not sufficient, an additional pressurized air container can be used. It is preferable to remove the second container 40 prior to the cleaning step.

Before starting the cleaning and renovating process, all valves of the apparatus 10 are tightly closed. After the air compressor is turned on and begins to supply pressurized air, the first main control valve 18 is opened. The air pressure indicator 22 indicates the desired air pressure. The second main control valve 20 is then gradually opened until preferably being one-third open for the first step. The air flow under pressure passes through the section of the pipeline being cleaned at increasing speeds so that the deposits which are relatively easy to remove from the incrustation are removed, and together with the water remaining therein are blown out gradually, in order to avoid clogging. The operation of the second main control valve 20 is carefully manually conducted to correspond with the exhaust flow discharged from the exit end of the section of the pipeline being cleaned. When no significant amount of waste material mixed with the exhaust flow is observed, the second main control valve 20 is gradually further opened to a position about its two-thirds opening and then still further to be fully open. During this step, the first main control 18 is closed and reopened several times and this close and reopen operating pattern causes the pressurized air to suddenly surge which helps clear the removed deposits away from the sections of the pipeline being cleaned.

When a wet operation, for example with water is desired, the second container 40 is installed prior to the preliminary air cleaning step and the valve 48 is opened for the addition of water through the input pipe 46 into the container 40. After the valve 48 is closed, the valve 52 is opened to provide a back pressure to the second container 40. The valve 44 is then opened to allow water to be delivered into the connection pipe 12 when the first and second main control valves 18, 20 are operated to conduct the preliminary air cleaning step, as described above. The valve 44 can be closed and reopened several times, corresponding to the operation of the first main control valve 18.

After this preliminary air cleaning step, the remaining deposits adhering to the inner surface of the section of the pipeline being cleaned are those which are relatively difficult to remove. Nevertheless, the internal passage of the section of the pipeline being cleaned now has a larger cross-section than it had prior to the preliminary cleaning step, which facilitates the subsequent sand cleaning step.

After the preliminary air cleaning step, the valve 34 is opened and sand particles sized from 1 mm to 5 mm is added through the input pipe 32 into the sand container 26. The valve 34 is closed immediately after the sand loading process is completed. The second main control valve 20 is closed during the sand loading process. Before the second main control valve 20 is opened again to begin the sand cleaning step, the valve 38 is opened first to provide a back pressure to the sand container 26. The second main control valve 20 is then fully opened to induce a substantially helical flow pattern through the section of the pipeline being cleaned. The air pressure is selected to generate an air flow having a preferable flow speed of, for example 70–80 m/sec. The valve 30 is controlled to. gradually open such that the sand is released from the sand container 26 gradually in order to avoid clogging in the section of the pipeline being cleaned. Optionally, valve 30 and the main control valves 18 or 20 may be closed arid reopened several times during the sand cleaning step. Such an operation can be repeated until no waste material is observed in the exhaust flow discharged from the exit end of the section of the pipeline. The pressure indicators 22, 24 are observed. The readings of both indicators 22, 24 are significantly below the predetermined air pressure and indicate a pressure differential therebetween when the air flow passes the section of the pipeline being cleaned. Otherwise, the section of the pipeline being cleaned is clogged and the sand cleaning step must be stopped immediately. The sand cleaning step begins again after actions have been taken to unclog the section of pipeline being cleaned.

In a wet operation with water, after the valve 52 is opened to provide a back pressure to the second container 40, the valve 44 is gradually opened, and may be closed and reopened several times, corresponding to the operation of valve 30. Thus, the water addition into the section of the pipeline being cleaned is well controlled and is substantially synchronized with the addition of the sand particles.

When the sand cleaning step is completed the valves 30 and 38, as well as the second main control valve 20 are closed and then the sand container 26 is removed. If the second container 40 was installed and used for a wet operation, the valves 44 and 52 are closed and then the second container 40 is removed. The second main control valve 20 is then fully reopened to provide the pressurized air through the section of the pipeline to thoroughly clean the inner surface of the section of the pipeline.

In order to conduct the coating step, the second container 40 is emptied and cleaned, and is then installed. The valve 48 is then opened for addition of rosin through the input pipe 46 into the container 40. After the valve 48 is closed, the valve 52 is opened to provide a backpressure to the second container 40. The valve 44 is then fully opened to allow the rosin to be delivered in its total amount at one time into the connection pipe 12, after which the valve 44 is immediately closed. The second main control valve 20 is then fully opened to apply the selected air pressure which was observed on the pressure indicator 22 prior to the opening of the second main control valve 20. Thus, the rosin is blown into the section of the pipeline and is mixed with the air flow in a substantially helical flow pattern, and thus the rosin moves: on and along the inner surface of the section of the pipeline, thereby forming a thin film of rosin evenly covering the entire inner surface of the section of the pipeline.

After the coating step is completed, the second main control valve 20 is partially closed to maintain an air flow at a relatively low flow speed passing through the section of the pipeline until the rosin coating on the inner surface thereof is completely dry. At this stage, the air compressor is switched off and all valves are closed. The apparatus 10 can be disconnected and removed, and then the cleaned and renovated section of the pipeline is ready to be reconnected to the pipeline.

Nevertheless, it is preferable in the coating step to add the rosin material directly into the connection pipe 12. The rosin material can be added through the input pipe 42 and the valve 44 into the connection pipe 12 or the rosin material can simply be added into the entry end of the section of the pipeline, or into the extension pipe connected to the connection pipe 12, which requires disconnection of the entry end of the section of the pipeline from the connection pipe 12, or from its extension pipe, for the addition of the rosin material. Thus, the second container 40 should not be used for containing rosin which is difficult to clean, because the rosin residue may mix with water and be inadvertently added into the section of the pipeline during the preliminary air cleaning or sand cleaning steps when the second container 40 is re-used for containing water for a subsequent wet operation. This can cause clogging, and therefore is not desirable.

If hot air is needed to dry the section of the pipeline prior to the preliminary air cleaning step or the sand cleaning step, and to dry the rosin coating after the coating step, an electric heating device (not shown) may be additionally connected either between the apparatus 10 and the entry end of the section of the pipeline, or between the air compressor and the apparatus 10. The heating device has connection pipes which have a diameter preferably similar to the diameter of the section of the pipeline being cleaned. Nevertheless, in the wet operation, the section of the pipeline to be cleaned need not be dried and therefore, the electric heating device is not needed.

The pipeline cleaning and renovating method of the present invention can be broadly applied for various pipelines such as water, gas, oil pipelines.

Modifications and improvements to the above-described embodiments of the present invention may become apparent to those skilled in the art. The foregoing description is intended to be exemplary rather than limiting. The scope of the invention is therefore intended to be limited solely by the scope of the appended claims.

What is claimed is:

1. A method of cleaning a pipeline having open entry and exit ends, comprising steps of:

introducing a flow of pressurized air into the entry end of the pipeline;

introducing a plurality of abrasive particulates into the flow of pressurized air at the entry end of the pipeline by means of a back pressure of the pressurized air;

controlling the flow of pressurized air at the entry end of the pipeline to have a speed of between 40 m/sec and 100 m/sec to induce a substantially helical flow pattern along an inner surface of the pipeline, thereby causing a substantial amount of the abrasive particulates to move along the inner surface of the pipeline; and introducing a liquid under a back pressure of the pressurized air into the flow of the pressurized air at the entry end of the pipeline when introducing the abrasive particulates, thereby generating or increasing a moisture content of flow of pressurized air and thereby increasing a density of the flow of pressurized air such that the flow of the pressurized air drives the abrasive particulates powerfully to remove the deposits on the inner surface of the pipeline.

2. A method as claimed in claim 1 wherein the air flow is controlled to have a speed substantially between 70–80 m/sec in order to induce the substantially helical flow pattern.

3. A method as claimed in claims 1 further comprising a step after the pipeline is cleaned, of introducing a coating material into the pipeline by an air flow in a substantially helical flow pattern along the inner surface of the pipeline from the entry end to the exit end thereof, thereby moving a substantial amount of the coating material in the substantially helical flow pattern on and along the inner surface of the pipeline.

4. A method as claimed in claim 3 wherein the coating material is rosin.

5. A method as claimed in claim 1 wherein the liquid comprises water.

6. A method as claimed in claim 1 wherein the liquid is selected such that the liquid can at least partially dissolve a solid or semi-solid material which is included in deposits adhering to and to be removed from an inner surface of the pipeline.

7. A method as claimed in claim 1 wherein the pressurized air ranges from 2 $kg/cm^2$ to 8 $kg/cm^2$.

8. A method as claimed in claim 1 wherein the abrasive particulates comprise sand particles sized from 1 mm to 5 mm.

9. A method as claimed in claim 1 wherein the introduction of the abrasive particulates is conducted by using an apparatus including a connection pipe having a first end connected to a source of pressurized air, a second end connected to the entry end of the pipeline and a first container positioned above the connection pipe for containing the abrasive particulates, the first container including a delivery pipe with a first valve connecting the connection pipe for delivering the abrasive particulates into the connection pipe, and a back pressure pipe with a second valve connecting the connection pipe at a point upstream of the delivery pipe for providing back pressure to the container.

10. A method as claimed in claim 9 further comprising steps of firstly opening the second valve in order to provide back pressure to the first container, and then gradually opening the first valve for introduction of the abrasive particulates into the pipeline.

11. A method as claimed in claim 10 wherein the controlling of the flow of pressurized air is conducted by operating a first main control valve installed in the connection pipe upstream of the back pressure pipe of the first container and a second main control valve installed in the connection pipe downstream of the back pressure pipe but upstream of the delivery pipe of the first container.

12. A method as claimed in claim 11 wherein the introduction of the liquid is conducted by using a second container of the apparatus, the second container including a delivery pipe with a first valve connected to the connection pipe at a point downstream of the delivery pipe of the first container, and a back pressure pipe with a valve connecting the connection pipe at a point between the first and second main control valves.

13. A method as claimed in claim 1 wherein the introduction of the liquid is substantially synchronized with the introduction of the abrasive particulates.

14. A method as claimed in claim 1 further comprising a preliminary cleaning step of introducing a mixed stream of air and a liquid under pressure into and through the pipeline prior to the introduction of abrasive particulates and the liquid.

15. A method of cleaning a pipeline having open entry and exit ends, comprising:

introducing a flow of pressurized air into the entry end of the pipeline;

introducing a plurality of abrasive particulates into the flow of pressurized air at the entry end of the pipeline by means of a back pressure of the pressurized air;

controlling the flow of pressurized air at the entry end of the pipeline such that the flow of pressurized air has a speed of between 40 m/sec and 100 m/sec; and introducing a liquid into the flow of pressurized air at the entry end of the pipeline, thereby generating or increasing moisture content of flow of pressurized air and thereby increasing a density of the flow of pressurized air to drive the abrasive particulates powerfully to remove deposits on an inner surface of the pipeline.

16. A method as claimed in claim 15 wherein the liquid comprises water.

17. A method as claimed in claim 16 wherein the speed of the flow of the pressurized air is between 70 m/sec and 100 m/sec.

* * * * *